US010844672B2

(12) United States Patent
Dziekonski

(10) Patent No.: US 10,844,672 B2
(45) Date of Patent: Nov. 24, 2020

(54) VIBRATION REDUCING DRILL STRING SYSTEM AND METHOD

(71) Applicant: Mitchell Z. Dziekonski, Stafford, TX (US)

(72) Inventor: Mitchell Z. Dziekonski, Stafford, TX (US)

( * ) Notice: Subject to any disclaimer, the term of this patent is extended or adjusted under 35 U.S.C. 154(b) by 159 days.

(21) Appl. No.: 15/982,368

(22) Filed: May 17, 2018

(65) Prior Publication Data

US 2018/0334863 A1 Nov. 22, 2018

Related U.S. Application Data

(60) Provisional application No. 62/508,475, filed on May 19, 2017.

(51) Int. Cl.

| | |
|---|---|
| ***E21B 17/07*** | (2006.01) |
| ***E21B 44/00*** | (2006.01) |
| ***E21B 7/24*** | (2006.01) |
| ***E21B 28/00*** | (2006.01) |

(52) U.S. Cl.

CPC ..... *E21B 17/07* (2013.01); *E21B 7/24* (2013.01); *E21B 28/00* (2013.01); *E21B 44/00* (2013.01)

(58) Field of Classification Search

CPC . E21B 17/07; E21B 28/00; E21B 7/24; E21B 44/00

See application file for complete search history.

(56) References Cited

U.S. PATENT DOCUMENTS

| | | | | |
|---|---|---|---|---|
| 2,808,231 | A * | 10/1957 | Kimbrell | E21B 17/00 285/55 |
| 4,384,625 | A * | 5/1983 | Roper | E21B 7/04 175/56 |
| 4,483,399 | A * | 11/1984 | Colgate | E21B 7/20 166/207 |
| 5,042,597 | A | 8/1991 | Rehm et al. | |
| 6,364,039 | B1 * | 4/2002 | Majkovic | E21B 17/073 175/320 |
| 7,828,082 | B2 * | 11/2010 | Pabon | E21B 17/07 175/56 |
| 2003/0010534 | A1 | 1/2003 | Chen et al. | |
| 2005/0217898 | A1 | 10/2005 | Clark | |
| 2008/0087351 | A1 * | 4/2008 | Paulshus | E21B 17/01 138/141 |
| 2010/0126776 | A1 * | 5/2010 | Trevino | E21B 17/07 175/61 |

(Continued)

OTHER PUBLICATIONS

International Search Report and Written Opinion for PCT/U518/033513 dated Aug. 24, 2018; 9 pages.

*Primary Examiner* — Michael R Wills, III
(74) *Attorney, Agent, or Firm* — Fletcher Yoder, P.C.

(57) ABSTRACT

A drill string is comprised of a vibration damping drill pipe section, made of a material such as aluminum alloy, titanium, composite material, or ductile iron, for example, and another drill pipe section made of a different material, such as conventional steel. The vibration damping drill pipe section may be place in any desired location, such as near sensitive equipment, such as a bottom hole assembly. Additional vibration damping sections may be interspersed with conventional drill pipe. The vibration damping drill pipe helps to reduce vibration experienced by the drill string during drilling, particularly torsional and lateral vibration.

20 Claims, 4 Drawing Sheets

(56) References Cited

U.S. PATENT DOCUMENTS

| | | | | |
|---|---|---|---|---|
| 2010/0224410 | A1 | 9/2010 | Wassell et al. | |
| 2013/0043076 | A1 | 2/2013 | Larronde et al. | |
| 2014/0367172 | A1* | 12/2014 | Evans | E21B 17/00 175/62 |

* cited by examiner

VIBRATION REDUCING DRILL STRING SYSTEM AND METHOD

CROSS-REFERENCE TO RELATED APPLICATIONS

This application claims priority from and the benefit of U.S. Provisional Application Ser. No. 62/508,475, entitled "Vibration Reducing Drill String System and Method," filed May 19, 2017, which is hereby incorporated by reference in its entirety.

BACKGROUND

The invention relates generally to drill strings, such as those used to access horizons of interest for oil and gas exploration and production.

The development of technologies for exploration for and access to minerals in subterranean environments has made tremendous strides over past decades. While wells may be drilled and worked for many different reasons, of particular interest are those used to access petroleum, natural gas, and other fuels. Such wells may be located both on land and at sea. Particular challenges are posed by both environments, and in many cases the sea-based wells are more demanding in terms of design and implementation. A particular issue in drilling involves extreme levels of vibration that can be caused by interaction of the drill bit at the bottom or far end of a drill string with geological structures encountered and that must be traversed to reach horizons of interest.

Drill string vibrations are a significant concern during drilling operations, and are a common cause of downhole tool failures, failures of more sensitive equipment, such as components of a critical bottom hole assembly (BHA), or other part of the equipment. Drill string vibrations are typically categorized in three ways: axial (the drill string is vibrating along the axis of drilling), lateral (the drill string is vibrating perpendicular to the axis of drilling), and torsional (the drill string is rotating along the axis of rotation). Vibrations are induced in a multitude of ways including at the drill floor, the drill bit cutting rock, rotating an imbalanced mass (sections of the BHA), etc.

There is a need in the art for improved ways of reducing such vibration, or for at least mitigating or localizing some of its effects.

BRIEF DESCRIPTION

In accordance with certain aspects of the technology, a drill string comprises a vibration damping drill pipe section assembled at a location where vibration damping is desired, the vibration damping drill pipe section comprising a plurality of pipe segments made of a vibration damping material, and a further drill pipe section made of a different material less able to dampen vibration experienced by the drill string during drilling.

In accordance with a further aspect, the drill string comprises a drill bit, a bottom hole assembly adjacent to the drill bit, and a vibration damping drill pipe section adjacent to the bottom hole assembly opposite to the drill bit, the vibration damping drill pipe section comprising a plurality of pipe segments made of a vibration damping material. A further drill pipe section is disposed adjacent to the vibration damping drill pipe section opposite the bottom hole assembly and made of a different material less able to dampen vibration experienced by the drill string during drilling.

The techniques also provide a method for making a drill string, comprising assembling a drill bit and bottom hole assembly, assembling a vibration damping drill pipe section adjacent to the bottom hole assembly as drilling advances into a well, and assembling a further drill pipe section adjacent to the vibration damping drill pipe section opposite the bottom hole assembly and made of a different material less able to dampen vibration experienced by the drill string as drilling advances further into the well.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The systems and methods described allow for significantly reduced vibration of drill strings and particularly of portions of the drill strings in the region of sensitive equipment, such as the BHA. The techniques may be based upon the use of low modulus and low density materials in a system that can dampen vibrations, and that can be applied to an oil and gas drilling environment with the use of aluminum drill pipe, titanium drill pipe, or composite drill pipe that compliments conventional steel pipe. In some embodiments materials that may be used may include ductile iron, which may provide vibration damping due to its microstructure. For example, the low modulus and density of aluminum can reduce both the duration and severity of torsional vibrations in a stick-slip type dysfunction. The reduction in severity of uncontrolled torsional oscillations will reduce the additional strain on threaded connections throughout the BHA and drill string, as well as the impact caused by lateral vibrations, and the amplitude of axial vibrations. This overall reduction in vibrations can have the benefit of increasing the life of sensitive downhole components (and the drill string elements themselves), and increasing the efficiency of drilling operations.

Figure 1:
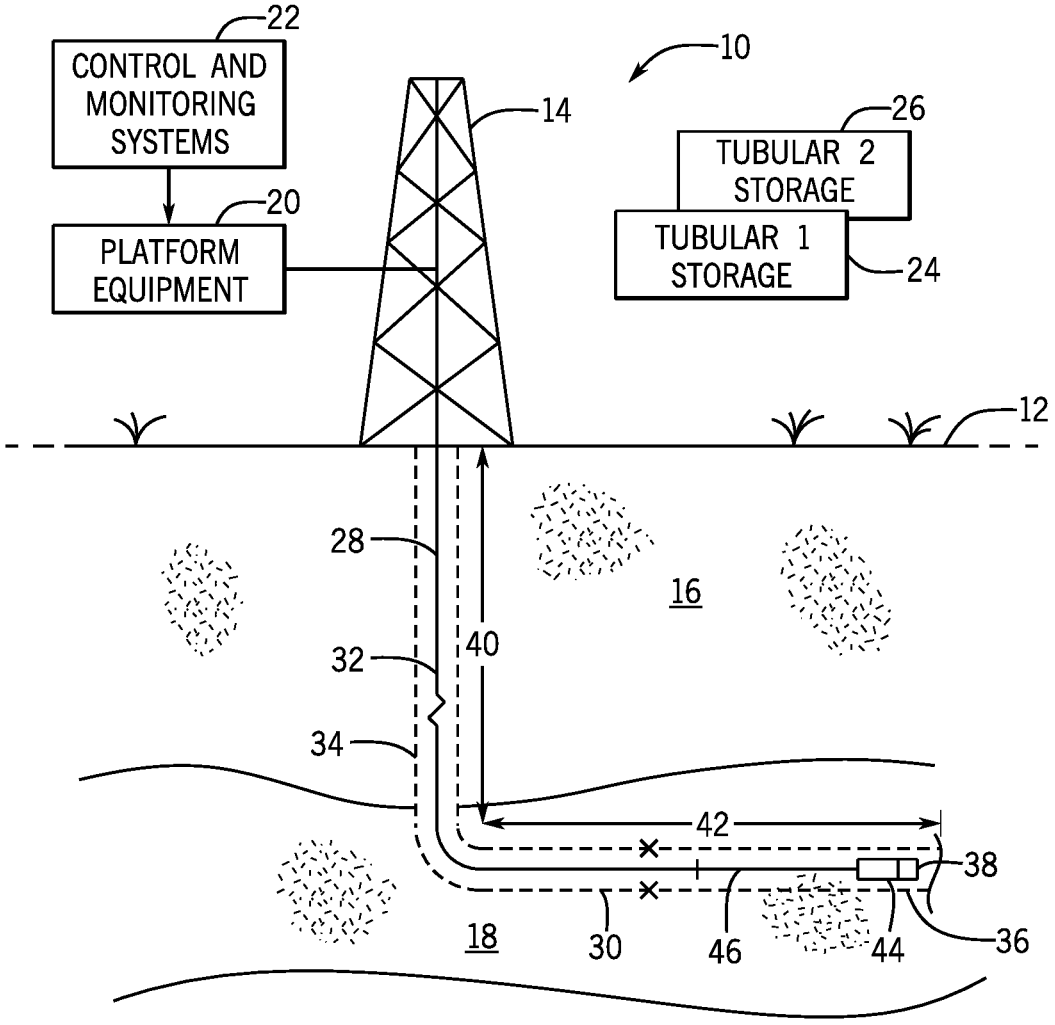
FIG. 1 is a diagrammatical representation of an exemplary drilling operation employing the present techniques.

Turning now to the drawings, and referring first to FIG. 1, a well system is illustrated and designated generally by the reference numeral 10. The system is illustrated as an onshore operation located on the earth's surface 12 although the present techniques are not limited to such operations, but may be used in offshore applications, in which the drilling and service equipment and systems described would be located on a vessel or platform, and the well would be located below a body of water. In FIG. 1, the underlying ground or earth is illustrated below the surface such that well equipment 14 is positioned near or over one or more wells. One or more subterranean horizons 16 are traversed by the well, which ultimately leads to one or more horizons of interest 18. The well and associated equipment permit, for example, accessing and extracting the hydrocarbons located in zones of interest, depending upon the purpose of the well. In many applications, the horizons will hold hydrocarbons that will ultimately be produced from the well, such as oil and/or gas. The well equipment may be used for any operation on the well, such as drilling, completion, workover, and so forth. In many operations the installation may be temporarily located at the well site, and additional components may be provided. However, in the present context, the tubular strings described are drill strings used to access the horizons by cutting or grinding rock and other subterranean formations as they are traversed.

In the illustration of FIG. 1, equipment is very generally shown, but it will be understood by those skilled in the art that much this equipment is conventional and is found in some form in many such operations. For example, a derrick 14 allows for various tools, instruments and tubular strings to be assembled and lowered into the well, traversing both the horizons 16 and entering or traversing the particular horizons of interest 18. Well or surface equipment 20 will typically include draw works, a rotary table, generators, instrumentations, and so forth. Control and monitoring systems 22 allow for monitoring all aspects of drilling, completion, workover or any other operations performed, as well as well conditions, such as pressures, flow rates, depths, rates of penetration, and so forth.

In accordance with the present disclosure, many different tubular stocks (e.g., drill pipe) may be provided and used by the operation, and these may be stored on any suitable racks or other storage locations. In FIG. 1 a first of these is designated tubular 1 storage 24, and the second is designated tubular 2 storage 26. As will be appreciated by those skilled in the art, such tubular products may comprise lengths of pipe with connectors at each end to allow for extended strings to be assembled, typically by screwing one into the other, or two tubular products connected via a single coupling. Different tubular stocks are used here to allow the operation to balance the technical qualities and performance possibilities of each against their costs. That is, one material may be selected for its relative strength but lower cost (e.g., steel), while the other is selected based upon its superior ability, such as low density and modulus, to be inserted into extended portions of the well for vibration damping, although it may be more costly than the first material. In presently contemplated embodiments, this second tubular stock may comprise, aluminum alloys, for example, but possibly also certain titanium alloys, composite materials, or metal matrix alloys. As discussed below, the operation judiciously selects which material to use based upon the nature of the well, the well position and geology, and the desire to reduce vibration during drilling.

In the illustration of FIG. 1, a drill string comprises a first, generally vertical section 28 that extends through the upper horizons 16, and an off-vertical section 30 that extends through at least a portion of the zone of interest 18. The vertical section is formed to access the horizon of interest, and may extend to any desired depth, such as 7,000 feet to 12,000 feet. The off-vertical section may extend at any desired angle from the vertical section, which may be generally perpendicular to the vertical section, although other angles for this section may be used. In practice, a well or a well system may access a number of locations in one or more horizons of interest by directional drilling to create one or more such off-vertical sections. The overall drill string 32 is illustrated as already deployed in the well for furthering the well bore through various formations and ultimately to the one or more of the formations of particular interest.

In this illustrated embodiment, the overall drill string 32 extends into a generally vertical section 34 of the wellbore, and into a generally horizontal section 36, as the wellbore is advanced by action of the drill bit 38. The drill string 32 extends a length 40 through the vertical section 34 of the well and through a length 42 of the off-vertical section 36, ultimately to the advancing bit 38. The drill string comprises a tubular string (e.g., pipe) that is run into the well during drilling. Such strings may comprise any suitable length of tubular products, and the number, size, and materials used for these will depend upon a number of factors, but typically the location of the horizon of interest (e.g., its depth and the length of the off-vertical section, if any), the distance to a location of interest, the depth of the water, if offshore, and so forth. In the illustrated embodiment, a bottom hole assembly or BHA 44 is positioned immediately adjacent to the bit 38. A length of vibration damping drill pipe 46 is then positioned adjacent to or near the BHA to aid in reducing vibrations in the drill string.

The drill string 32 and will typically be assembled by the well equipment, drawing from the tubular materials stored as discussed above. That is, various tools (e.g., drill bit, connectors, BHA with its associated instrumentation) are first assembled and placed into the well, followed by lengths of drill pipe by taking the pipe sections from the storage, threading them end-to-end, and deploying them progressively into the well. In presently contemplated embodiments, some of the drill string is made of vibration damping materials, such as aluminum alloy, for example, or another material that enables the drill string to attenuate the levels or effects of vibration (e.g., titanium alloy, composite material, metal matrix alloys). The other sections of drill pipe may be made of conventional materials, such as steel. As noted above, vibration damping materials suitable for use in the present techniques may include ductile iron, at least partially due to the damping abilities of its microstructure. The tubular sections assembled in this way may comprise, for example, multiple sections of standard length (e.g., 30 or 40 foot sections) each having industry standard end connectors to facilitate their assembly. By way of example only, while the vertical section of the well may extend as much as 7,000 to 12,000 or more feet vertically into the earth (note that the "vertical" section need not be strictly vertical, but may be inclined in at least a part of the well), the off-horizon section may extend another 5,000 to 20,000 feet. In some embodiments, as discussed below, the vibration damping sections may be placed closest to the BHA, although other sections may be placed at other locations in the drill string.

Axial vibrations are typically manifestations of compressive waves that travel along the axis of the drill string. Also called "bit bounce," these vibrations cause the cutters on the drill bit to lose depth, reducing effectiveness of the drilling operations. In extreme cases, the drill bit loses all contact with the formation, and re-engages at a high velocity. This can cause undesirable damage to the bit.

Torsional vibrations are sometimes referred to as "stick-slip" vibrations. These are variations in the rotational speed in the drill string. In extreme cases (full stick-slip), the drill bit will stop rotating entirely, allowing for torsional energy to build up in the drill string. This torsional energy unwinds in an extremely high angular velocity release. This build up and release of the torsional energy causes high stress cycles on the drill string, and on the threaded connections in particular. These vibrations are most severe closer to the drill bit, which is typically also where the majority of sensitive components are located.

More particularly, torque is applied from the rig floor and transferred via the drill string to the drill bit. This turning force, along with the weight of the drill string, allows the drill bit to cut through subsurface geologic formations. The drill bit is impregnated with hardened inserts, or cutters, that are angled such that when an axial force and rotational moment are applied, will shear off small sections of rock called cuttings. The cuttings are traditionally carried to the surface via a thickened fluid called "drilling mud" which is pumped from the surface through drill string, and moves back to surface through the annulus formed between the outside of the drill pipe and the newly cut wellbore. This process allows the drill string to advance through the formation.

When drilling normally, the rotation of the drill bit is steady and predictable. A dysfunction can occur where the cutters momentarily get stuck, or "stick," on a section of rock. Regardless of any sticking or stopping of the bit the drilling rig is still turning the drill string at the surface, which causes torsional energy to build up in the drill string. After enough time, the increased torsional energy allows for the drill bit to destroy the rock that it was stuck on, and be released, or "slip." The built up torsional energy dissipates through the bit in the form of increased rotational speed for a short period of time, until the excess torsional energy is exhausted. This dysfunction can occur repeatedly during drilling operations. When this happens, the drill bit and tools in the drill string are forced to accelerate at a rate beyond typical operations. This change in rotational speed also affects the amount of rock that is cut during each rotation of the bit, slowing down the operations as a whole. These uncontrolled torsional oscillations of the drill string reduce the effectiveness of the drilling operations and cost the operator time and money. There are various ways to reduce these vibrations, including momentarily pausing drilling operations to allow for the vibrations to dampen and dissipate naturally.

Lateral vibrations are caused by rotating elements of the drill string, particularly elements with a mass imbalance, coupled with friction against the wellbore wall. This causes the drill string to oscillate up and down the wellbore wall, and can cause the drill string to break contact with the wellbore, and reengage at a high velocity. Typically these vibrations are categorized as "forward whirl," where the oscillation of the drill string in the borehole is the same rotational direction as the drill string, and "backward whirl," where the oscillation is opposite of the rotation of the drill string. A third form, "chaotic whirl," occurs when the oscillations are not in a pattern which correlates with the drill string rotation. These vibrations can cause damage to sensitive internal components. Lateral movement is also caused by torsional vibrations. When the torsional energy is released, drill string elements forcibly shake in the wellbore and can impact the wellbore walls at a high velocity.

In particular, all drilling activity causes movement of the tubulars perpendicular to the axis of the drill string. During rotation of the drill string friction is generated between the wellbore wall and the tubulars because of this rotation. This friction forces the tubular to ride up one side of the wellbore, and along with other forces including mass imbalances in some of the drilling tools, causes the drill string to oscillate up and down the well bore wall. In some cases, this movement can become erratic. The vibrations resulting from the "whirl" mentioned above are generally referred to as "lateral vibrations" and in extreme cases, these vibrations, particularly backward whirl, cause the drill string to make contact with the wellbore walls with a high velocity and acceleration, called shock, which can cause damage or premature failure to drilling tools.

Mechanical connections affected by the vibration become fatigued far more quickly than what would be expected under normal operations. Sensitive electronic or mechanical components in a measuring while drilling (MWD) tool are especially prone to damage with this type of vibration. These vibrations also cause energy intended to be transferred to the bit for the purpose of cutting rock to be expelled prematurely throughout the drill string, reducing the rate at which the drill bit cuts rock.

Once this vibratory pattern has been realized in the drill string, measures are often taken to resolve it as quickly as possible. These measures can include again momentarily stopping the drilling operations completely and allowing for the vibrations to dampen and subside on their own. This solution is not ideal as it reduces the overall effectiveness of the operations. If a sensitive component breaks downhole, the operator is forced to either continue drilling "blind" or without the information this tool provides, or do a "trip" in which the drill string is pulled to surface so the broken tool can be fixed or replaced. These scenarios will likely reduce the quality of the hole being drilled, and cost the operator additional time and money.

More generally, all such vibration reduces the efficiency of the drilling operation. That is, ideally, all energy input to the drill string should result in cutting or removal of the underground formations and advancement of the drill string. Vibration ultimately consumes a portion of this energy, reducing the efficiency of the operation. Any reduction in the amount or effects of the vibration should improve this drilling efficiency.

The techniques described allow for reduction, damping, attenuation, or reduction of the effect of some or all of these forms of vibration. In particular, introducing into the drill string a specified length of drill pipe made of a vibration damping material (e.g., aluminum) can reduce the magnitude and duration of both torsional and lateral vibrations. Due to the low modulus and low density of such alloys, the material is able to absorb vibrations that would otherwise be transmitted to other components in the drill string. A relatively small amount of aluminum drill pipe may suffice relative to the length of the entire drill string. Currently this length is theorized to be between 500 and 2,000 feet in a drill string that can be between 10,000 and 30,000 feet overall. In some embodiments, the length of a vibration damping section may be reduced to one stand (typically three 40 foot joints, or 120 feet). Introducing the aluminum drill pipe would reduce delays in drilling operations and avoid damage done to sensitive components, significantly increasing the effectiveness of the drilling operations.

Figure 2:
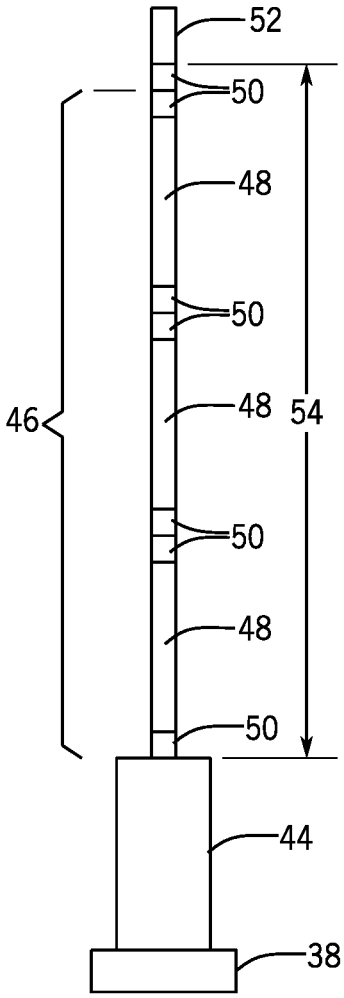
FIG. 2 is a diagrammatical representation of a sections of a drill string incorporating a vibration damping section.

FIG. 2 illustrates a section of a drill string assembled to reduce vibration. In this illustration, the drill bit 38 is shown adjacent to the BHA 44. The vibration damping drill string section or stand 46 is shown as comprising 3 segments of pipe 48, with screwed connections 50 between them and at ends of the section. At the upper end of the vibration damping section 46 begins a section of conventional drill pipe 52. The vibration damping section extends over a desired length 54 selected to provide the desired vibration damping. Presently contemplated lengths 54 may between 90 and 2,000 feet in length, and may be made up of pipe segments of 30 or 40 feet (standard lengths). By comparison, the BHA may be some 100-300 feet in length, while the overall drill string will typically be many thousands of feet long.

Figure 3:
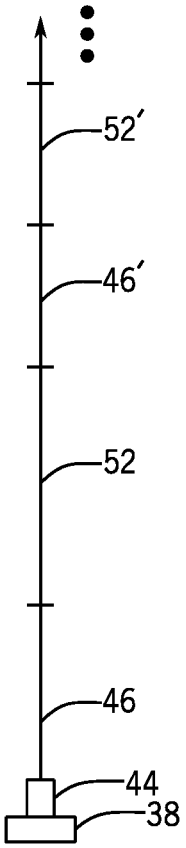
FIG. 3 is a diagrammatical representation of another drill string incorporating more than one vibration damping sections.

In some embodiments and environments it may be useful to provide more than one vibration damping section. FIG. 3 illustrates such a drill string. In this case, a first vibration damping section 46 is again provided near the BHA 44, with a section of conventional steel pipe 52 connected above it. Then above that section, another length of vibration damping pipe 46' if provided, followed by another section of conventional drill pipe 52'. Further sections of vibration damping pipe may also be provided further along the drill string. It should be noted, as well, that vibration damping sections may be placed anywhere along the string, with multiple such sections being separated by conventional tubular products. In some embodiments, for example, it may be useful to place vibration damping sections every two or more thousand feet. Such placement may depend upon such factors as the size of the tubular product, the loads encountered, the well conditions, and so forth.

Figure 4:
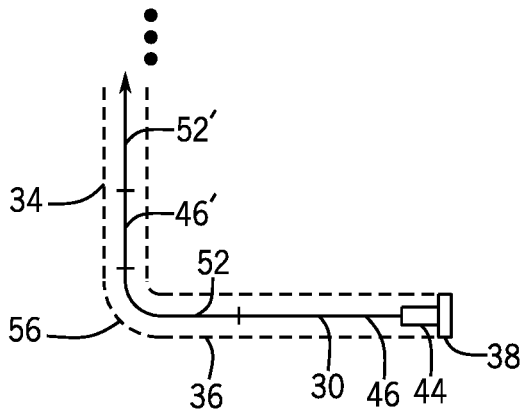
FIG. 4 is a diagrammatical representation of another drill string incorporating more than one vibration damping sections in desired locations.

In certain well and borehole profiles and trajectories, such vibration damping sections may be judiciously located to provide desired damping in regions where such vibration is anticipated to be particularly troublesome. FIG. 4 illustrates an application in which a wellbore has vertical and off-vertical sections 34 and 36 as discussed above, with a heel section 56 transitioning between the two. A vibration damping drill pipe section 46 is here again positioned adjacent to the BHA 44. But to help reduce anticipated vibration above the heel section 56 of the wellbore, the drill string has a further vibration damping section 46' that may be added to the drill string in a location that will be deployed at, around, or above the heel section.

Figure 5:
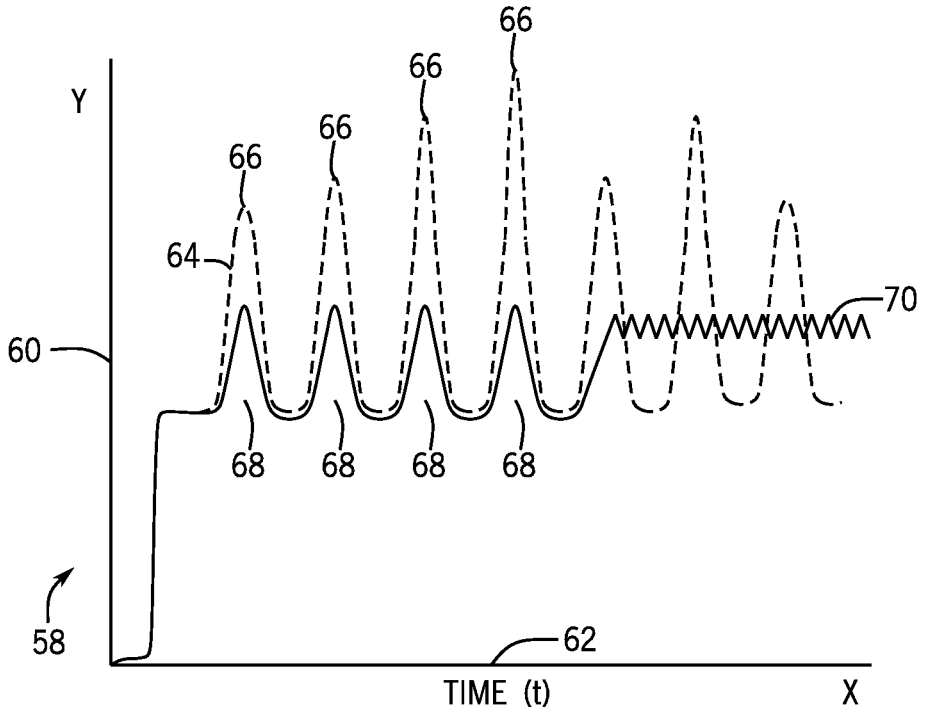
FIG. 5 is an idealized exemplary vibration profile comparison between a drill string of the prior art and one incorporating a vibration damping section.

It is believed that the presence of the vibration damping drill pipe sections, even in relatively short sections as compared to the overall drill string may significantly affect the vibration experienced by the drill string, and particularly by those components near the vibration damping sections, such as the BHA and/or the drill bit. FIG. 5 is a graphical representation 58 of anticipated effects on vibration at such locations. In this illustration, vibration magnitude 60 is shown by a vertical axis over time along a horizontal axis 62. The dashed trace 64 represents a vibration profile of a conventional drill string at a location of the BHA or drill bit. Significant peaks 66 can be anticipated at a frequency corresponding to the dynamics of movement of the end of the drill pipe during drilling. A vibration profile of a drill string having at least one vibration damping section adjacent to this location is represented by the solid trace having significantly reduced peaks, and ultimately settling into a higher frequency, lower peak, and lower variability dynamic region 70.

Figure 6:
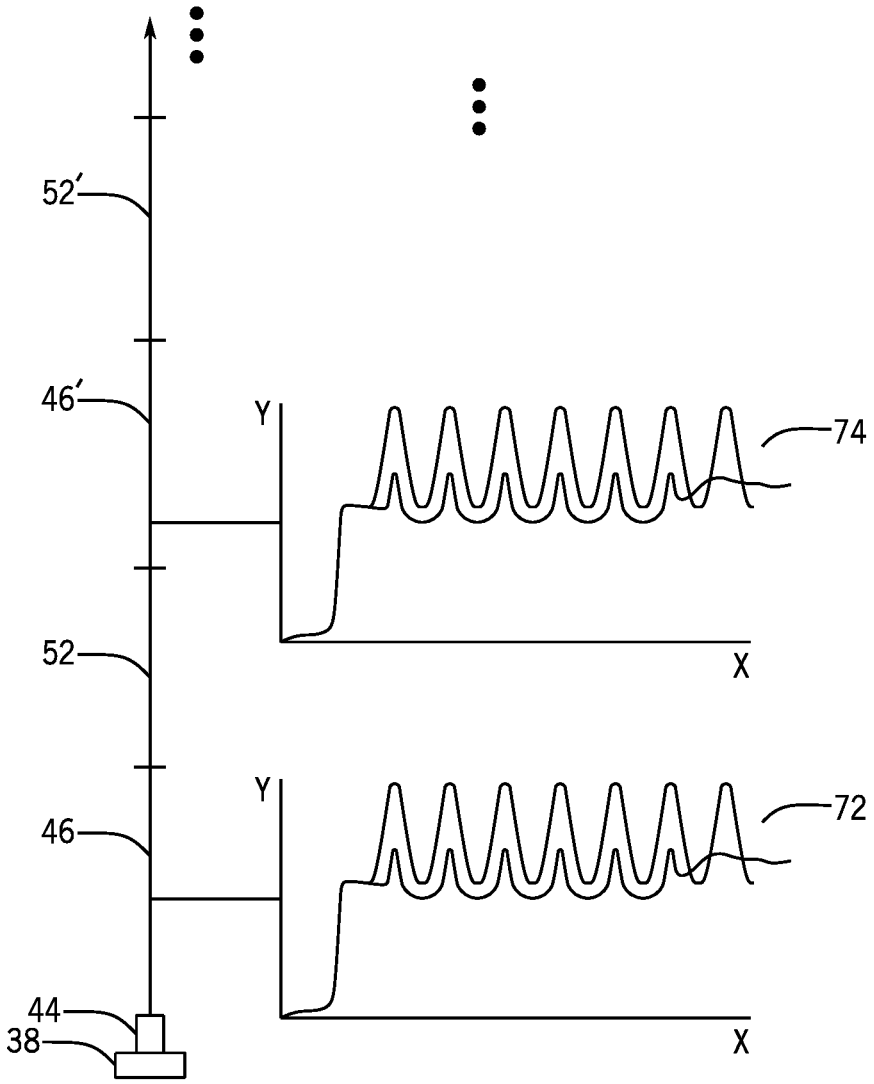
FIG. 6 is a diagrammatical representation of a drill string incorporating multiple vibration damping sections along with idealized vibration profiles along the drill string.

Similar attenuations are anticipated for drill strings having more than one vibration damping sections, as illustrated in FIG. 6. Here, a drill string similar to that of FIG. 3 is shown along with vibration profile comparison graphs 72 and 74 at locations adjacent to the vibration damping sections.

The material properties believed to be of particular interest in reducing vibration include modulus of elasticity, density, and damping characteristics. Regarding the modulus of elasticity, conventional steels used for well tubulars have a modulus typically on the order of 29.5 Mpsi, with typical ranges of 27 to 31 Mpsi. Aluminum alloy tubulars suitable for the present techniques have a modulus typically on the order of 10 Mpsi, with typical ranges of 9 to 11.5 Mpsi. Titanium tubulars contemplated for the present techniques, on the other hand, have a modulus typically on the order of 16.5 million psi, with typical ranges of 13.5 to 17 Mpsi. Suitable composites can be made to have a very low modulus, such as on the order of 5 Mpsi if required. Regarding the relative density of such materials, typical steel has a density of 0.285 pounds per cubic inch, aluminum has a typical density of 0.101 lbs./in^3, titanium has a typical density of 0.165 lbs./in^3, and composites can have densities ranging from less than 0.101 lbs./in^3 to more than 0.285 lbs./in^3.

Other properties may also be of interest, including properties related to the ability or tendency for such materials to convert vibrational movement to heat, thereby wasting or dissipating energy that could otherwise be used to advance the well. For example the internal friction and damping capacity of the material may be considered in the selection.

Regarding the specific materials that may be used, presently contemplated tubulars may be selected from aluminum tubulars, for example, from 2000, 6000, and 7000 series alloys, while titanium tubulars may be selected from so-called Alpha, Alpha-Beta and Beta alloy families. Suitable composites may include carbon fiber compositions or metal matrix alloys. As noted above, ductile iron products may also be usefully employed.

In practice, various methods may be employed for carrying out the drill string vibration damping approach discussed above. In general, the tool or tools that precede the vibration damping section will be assembled at the wellsite, and the drilling commenced. The vibration damping section will then be assembled along a desired length, such as adjacent to the BHA. As the drilling advances, the desired length of the vibration damping drill pipe is ultimately reached by attachment of successive lengths of the tubulars, followed by attachment of conventional drill pipe (e.g. steel). Then at further desired locations one or more additional lengths of vibration damping pipe may be inserted. In most cases the length of the vibration damping drill pipe may be estimated or calculated in advance based upon the anticipated well conditions. In some cases the additional sections may be inserted based upon vibrations actually experienced during drilling. In still other situations, the drill string may be fully or partially removed ("tripped out") and one or more vibration damping sections maybe added due to vibration experienced or anticipated.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A drill string for use in a well drilling system that comprises a rig that, in operation, drives the drill string in rotation in a well from a location above the well, the drill string comprising:

a vibration damping drill pipe section comprising drill pipe assembled to be deployed at a location where vibration damping is desired, the vibration damping drill pipe section comprising a plurality of pipe segments made of a vibration damping material;

a further drill pipe section assembled to the vibration damping drill pipe section and made of a different material less able to dampen vibration experienced by the drill string during rotation of the drill string by the drilling rig system;

wherein the drill string is advanced in the well only by rotation of the drill string by torque applied by the drilling rig system from the location above the well.

2. The drill string of claim 1, wherein the vibration damping material comprises an aluminum alloy.

3. The drill string of claim 1, wherein the vibration damping drill pipe section is disposed adjacent to a bottom hole assembly.

4. The drill string of claim 3, wherein the vibration damping drill pipe section is disposed immediately adjacent to the bottom hole assembly.

5. The drill string of claim 1, wherein the vibration damping material comprises a titanium alloy or a composite material.

6. The drill string of claim 1, wherein the vibration damping drill pipe section has a length of between about 90 feet and about 1,500 feet.

7. The drill string of claim 1, wherein the vibration damping drill pipe section has a length of less than 500 feet.

8. The drill string of claim 1, wherein the vibration damping drill pipe section has a length of less than 100 feet.

9. The drill string of claim 1, wherein the vibration damping drill pipe section has a length of less than about 20% of the overall length of the drill string.

10. The drill string of claim 1, comprising a plurality of vibration damping drill pipe sections made of vibration damping material alternated with drill pipe sections made of a different material less able to dampen vibration experienced by the drill string during drilling.

11. A drill string for use in a well drilling system that comprises a rig that, in operation, drives the drill string in rotation in a well from a location above the well, the drill string comprising:

a drill bit;

a bottom hole assembly adjacent to the drill bit;

a vibration damping drill pipe section comprising drill pipe adjacent to the bottom hole assembly opposite to the drill bit, the vibration damping drill pipe section comprising a plurality of pipe segments made of a vibration damping material; and a further drill pipe section adjacent to the vibration damping drill pipe section and made of a different material less able to dampen vibration experienced by the drill string during rotation of the drill string by the drilling rig system wherein the drill string is advanced in the well only by rotation of the drill string by torque applied by the drilling rig system from the location above the well.

12. The drill string of claim 11, wherein the vibration damping material comprises an aluminum alloy.

13. The drill string of claim 11, wherein the vibration damping drill pipe section has a length of between about 90 feet and about 1,500 feet.

14. The drill string of claim 11, wherein the vibration damping drill pipe section has a length of less than 500 feet.

15. The drill string of claim 11, wherein the vibration damping drill pipe section has a length of less than 100 feet.

16. A method for making a drill string comprising:

assembling a drill bit and bottom hole assembly;

assembling a vibration damping drill pipe section comprising drill pipe made of a vibration damping material; and assembling a further drill pipe section adjacent to the vibration damping drill pipe section and made of a different material less able to dampen vibration experienced by the drill string as drilling advances further into a well; and advancing the drill string in the well only by rotation of the drill string by torque applied by a well drilling system from a location above the well.

17. The method of claim 16, comprising assembling a further vibration damping drill pipe section above the further drill pipe section as drilling advances still further into the well.

18. The method of claim 16, wherein the vibration damping material comprises an aluminum alloy.

19. The method of claim 16, wherein the vibration damping drill pipe section has a length of between about 90 feet and about 1,500 feet.

20. The method of claim 16, wherein the vibration damping drill pipe section has a length of less than 500 feet.

* * * * *